US006105194A

United States Patent [19]

Rudolph

[11] Patent Number: 6,105,194

[45] Date of Patent: Aug. 22, 2000

[54] CLEANING IMPLEMENT HAVING A ROTATABLE HANDLE

[76] Inventor: Donald R. Rudolph, P.O. Box 34891, Las Vegas, Nev. 89133

[21] Appl. No.: 09/057,857

[22] Filed: Apr. 9, 1998

[51] Int. Cl.[7] ..... A46B 5/00

[52] U.S. Cl. ..... 15/145; 15/143.1

[58] Field of Search ..... 15/143.1, 145

[56] References Cited

U.S. PATENT DOCUMENTS

| | | | |
|---|---|---|---|
| 194,042 | 8/1877 | Jackson | 15/143.1 |
| 207,427 | 8/1878 | Lamboy | 15/143.1 |
| 695,197 | 3/1902 | Dillingham | 15/143.1 |
| 986,796 | 3/1911 | Behm | 403/236 |
| 987,981 | 3/1911 | Gross | 15/143.1 |
| 1,587,369 | 6/1926 | Flowers | 15/143.1 |
| 2,701,379 | 2/1955 | Balistreri | 15/143.1 |
| 2,772,910 | 12/1956 | Doyle | 294/58 |
| 3,423,781 | 1/1969 | Henson | 15/145 |
| 3,682,516 | 8/1972 | Savage | 15/145 |
| 4,231,604 | 11/1980 | Obergfell | 294/59 |
| 4,264,096 | 4/1981 | Barnett | 294/58 |
| 4,644,740 | 2/1987 | Lee | 56/400.04 |
| 4,958,407 | 9/1990 | Johnson | 16/114 R |
| 5,065,475 | 11/1991 | Watt | 16/114 R |
| 5,133,101 | 7/1992 | Hauser et al. | 15/143.1 |
| 5,447,349 | 9/1995 | Coble | 294/58 |
| 5,522,629 | 6/1996 | Loo | 294/51 |
| 5,581,839 | 12/1996 | Ferrell, Jr. | 15/143.1 |
| 5,625,922 | 5/1997 | Morad | 16/114 R |

*Primary Examiner*—Mark Spisich
*Assistant Examiner*—Theresa T. Snider
*Attorney, Agent, or Firm*—Kenneth L Tolar

[57] ABSTRACT

A cleaning implement such as a mop or broom having an elongated tubular handle with several independently rotatable portions for minimizing the strain on a user's wrist or forearm. The handle may be interchangeably connected to either a mop or broom head using a quick type connector at a distal end thereof. The connector relates to a pair of diametrically opposing pins which are slidably received within L-shaped slots on a body portion protruding from the mop and broom heads. Alternatively, the handle may be secured to a cylindrical adaptor likewise having a pair of L-shaped slots thereon. The adaptor has an externally threaded portion at a distal end for threadedly engaging internally threaded bores on certain conventional mop and broom heads.

6 Claims, 2 Drawing Sheets

18
8
9
4
2
5
5
5
6
10
13
11
12
2

CLEANING IMPLEMENT HAVING A ROTATABLE HANDLE

BACKGROUND OF THE INVENTION

The present invention relates to a cleaning device which may be interchangeably used as a broom or mop, and more specifically, a device having several independently rotatable portions to minimize strain on a user's forearm and wrist.

DESCRIPTION OF THE PRIOR ART

Manipulating a mop or broom can be stressful and painful to a user. When a person attempts to place a mop or broom head in isolated areas such as a comer, the handle must be rotated about its longitudinal axis placing great strain on the person's wrist or forearm. The problem is further exacerbated when the user has painful wrist and arm disorders such as carpal tunnel syndrome or arthritis. Several mop and broom handles and handle attachments exist in the prior art. For example, U.S. Pat. No. 5,625,922 issued to Morad relates to an apparatus for attaching to a broom handle. The device includes a handle member having a loop extending therefrom for receiving a broom handle allowing a user to grasp the broom in either a horizontal or a vertical direction.

U.S. Pat. No. 5,133,101 issued to Hauser et al relates to a handle for a mop comprising a foam rubber hand grip at an end thereof and a pair of diametrically opposed handles extending from an intermediate portion thereof. The diametrically opposed handles have rotatable foam rubber hand grips which along with the lateral spacing of the handles facilitate rotation of the mop head.

U.S. Pat. No. 4,958,407 issued to Johnson relates to an auxiliary tool handle comprising at least two curvilinear handle segments for removably mounting to a conventional handle. The curved handles are designed to provide a stronger, more comfortable grip.

U.S. Pat. No. 4,231,604 issued to Obergfell relates to a shovel having a blade and an elongated handle with a laterally extending enlargement. The device further includes a fulcrum mechanism designed to minimize strain to a user when using the shovel to lift a heavy load.

U.S. Pat. No. 2,701,379 issued to Balistreri relates to a handle grip comprising a cylindrical sleeve constructed of sponge rubber for surrounding a broom or mop handle. The device is designed not to rotate about the broom handle.

U.S. Pat. No. 986,796 issued to Behm relates to a reversible handle allowing hand operated devices to be used by either the right or left hand.

Although the patent issued to Hauser discloses a device for securing to a broom handle having rotatable hand grips, it does not relate to an elongated tubular handle having several independently rotatable portions integral therewith. The device also does not include an elongated tubular handle having a unique attachment means a distal end allowing the handle to be interchangeably used with an accompanying mop or broom head or other conventional mop or broom heads. The present invention provides a uniquely designed handle which may be interchangeably used with a broom or mop head that has a plurality of independently rotatable sleeves allowing the handle, and thus the broom or mop head, to freely rotate when grasped by a user.

SUMMARY OF THE INVENTION

The present invention relates to a cleaning implement which may be interchangeably used as a mop or broom having a handle with a plurality of independently rotatable segments. The device comprises an elongated tubular handle including a fixed segment having a tubular dowel protruding from an end thereof. Rotatably mounted to the tubular dowel are a plurality of independently rotatable sleeves. The sleeves are secured to the tubular dowel with an end cap threadedly engaging a distal end thereof. Proximal an opposing end of the fixed segment are a pair of diametrically opposed pins for selectively engaging a pair of L-shaped slots on a cleaning element such as a mop or broom head. Alternatively, an adaptor having an externally threaded portion may be secured to the pins so that the handle may be attached to conventional broom or mop heads that have threaded bores thereon. It is therefore an object of the present invention to provide a cleaning implement that may be interchangeably used as a mop or broom.

It is yet another object of the present invention to provide a cleaning implement having a tubular handle with a plurality of independently rotatable segments to reduce the strain on a user's wrist and forearm.

It is yet another object of the present invention to provide a cleaning implement having a an attachment means on its handle for quickly and easily attaching a mop or broom head thereto. Other objects, features and advantages of the present invention will become readily apparent from the following detailed description of the preferred embodiment when considered with the attached drawings and the appended claims.

DESCRIPTION OF THE PREFERRED EMBODIMENT

Figures 1, 2:
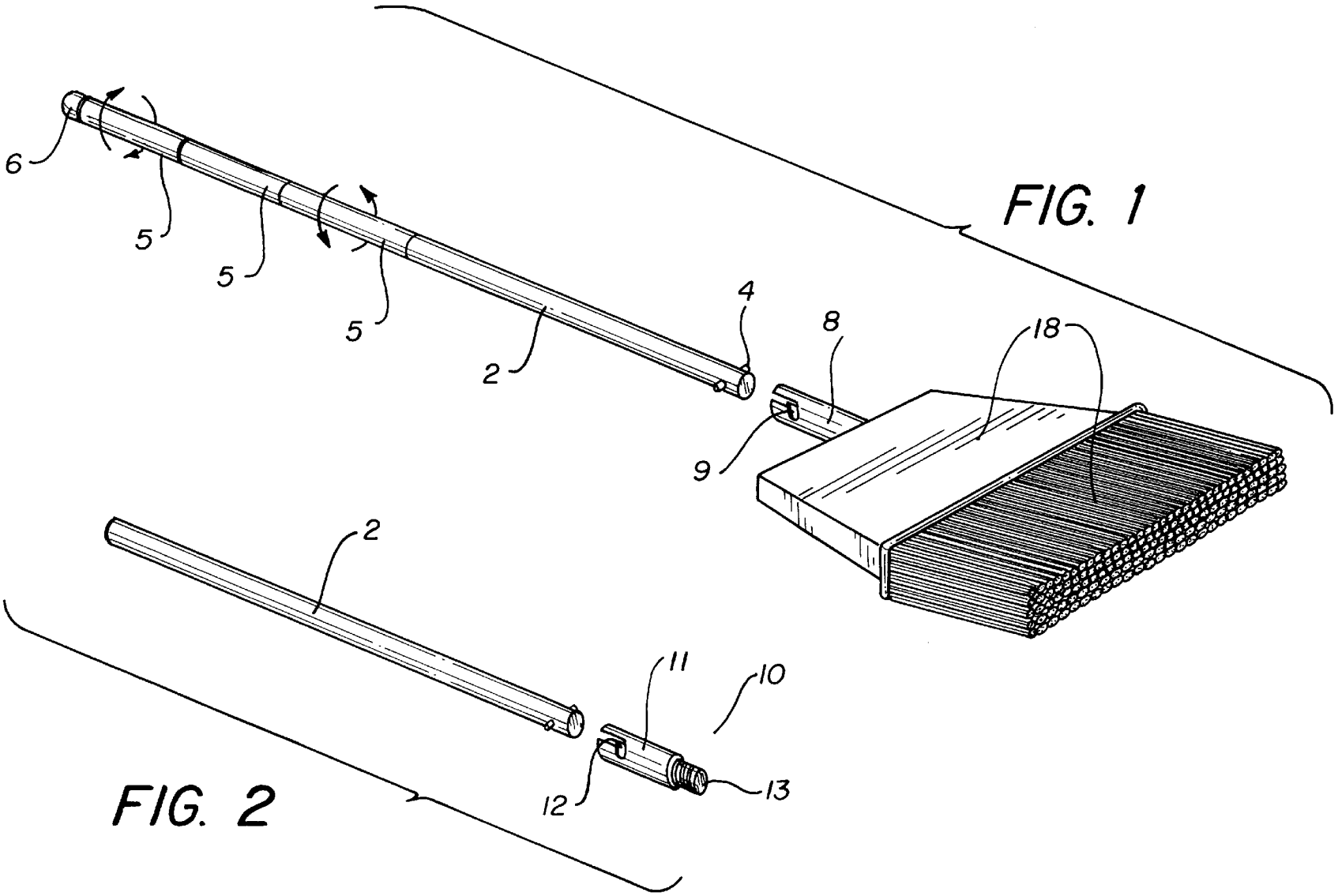
FIG. 1 depicts the inventive device with a broom head attached thereto.
FIG. 2 depicts the fixed segment with an optional adaptor adjacent thereto.
Figure 3:
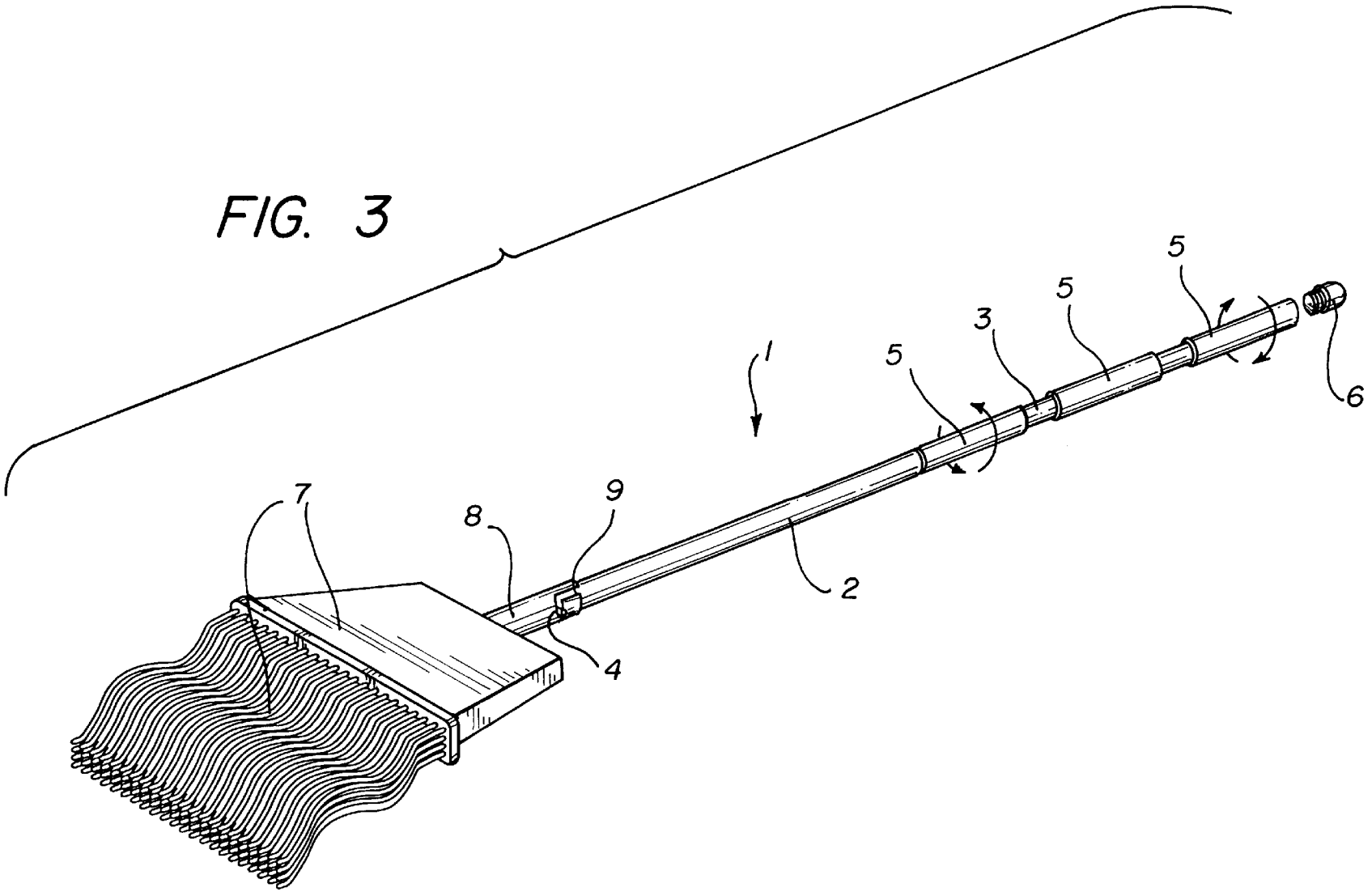
FIG. 3 depicts a slightly exploded view of the inventive device attached to a mop head.

Referring now to FIGS. 1 through 3, the present invention relates to a cleaning implement designed to minimize strain to the wrist or forearm of a user. The device comprises an elongated tubular handle member 1 including a fixed segment 2 having a smaller diameter tubular dowel 3 protruding from an end thereof. At an opposing end of the fixed segment are a pair of diametrically opposed pins 4 for attaching the handle member to a mop or broom head. Rotatably mounted to the dowel are a plurality of sleeves 5 each independently rotatable relative to the others. The sleeves provide rotatable hand grips which may be grasped by a user. The sleeves are secured to the dowel using a cap member 6 threadedly engaging a distal end thereof.

An accompanying cleaning element such as a mop 7 or broom 18 head may be interchangeably attached to the tubular handle. Both the mop and broom head resemble those known in the prior art and each have a cylindrical body portion 8 protruding therefrom with a pair of oppositely facing L-shaped slots 9 thereon. Accordingly, the pins on the fixed segment may be slid within the opposing slots and the fixed segment is rotated to lock the handle member to the cleaning element. The mop and broom head shown are intended as an example only and any type of conventional cleaning element may be used such as a sponge mop, a push broom head and similar devices.

An optional adapter 10 is provided which allows the handle to be attached to conventional broom or mop heads and other devices that have an internally threaded bore thereon. The adapter 10 comprises a short tubular body 11 having a pair of L-shaped slots 12 proximal a first end with an externally threaded portion 13 at a second end thereof. The adapter is secured to the tubular handle in a similar fashion as the mop or broom head. Accordingly, the handle may be secured to conventional cleaning elements in which their handles are threadedly received within a bore.

In the preferred embodiment, three rotatable sleeves are provided, any two of which may be grasped by a user. Alternatively, the user may grasp the fixed segment and a sleeve to rotate the mop or broom head to a desired position. Three sleeves are depicted and described, however, any number of one or more may be provided. The handle, broom, mop heads and rotating sleeves are preferably manufactured with plastic but any other material will suffice. However, as will be readily apparent to those skilled in the art, the number of sleeves, the materials of construction, the size and shape of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A cleaning implement comprising:

an elongated tubular handle including a fixed segment having upper and lower ends and a first diameter with an elongated tubular dowel having a second diameter smaller than the first diameter protruding from the upper end thereof;

a plurality of hollow, independently rotatable, adjacent sleeves rotatably mounted to said dowel;

a cleaning element;

means for attaching said cleaning element to the lower end of said fixed segment.

2. A cleaning implement according to claim 1 wherein said means for attaching a cleaning element to said fixed segment comprises:

a pair of diametrically opposed pins proximal the lower end of said first segment;

a cylindrical body portion on said cleaning element having a pair of opposing L-shaped slots thereon for slidably receiving said pins.

3. A cleaning implement according to claim 2 further comprising a cap member threadedly engaging a distal end of said dowel to retain said sleeves thereon.

4. A cleaning implement according to claim 3 wherein said cleaning element is a mop head.

5. A cleaning implement according to claim 3 wherein said cleaning element is a broom head.

6. A cleaning implement according to claim 1 wherein said means for attaching a cleaning element comprises an adapter having a cylindrical, tubular body with a pair of opposing L-shaped slots proximal an end thereof with an externally threaded portion at an opposing end for threadedly engaging a threaded bore on a said cleaning element.

* * * * *